US007384305B2

(12) United States Patent
Petersen et al.

(10) Patent No.: US 7,384,305 B2
(45) Date of Patent: Jun. 10, 2008

(54) HIGH DENSITY MOUNT FOR A CO-AXIAL CONNECTOR

(75) Inventors: Cyle D. Petersen, Belle Plaine, MN (US); Scott K. Baker, Richfield, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/373,499

(22) Filed: Mar. 9, 2006

(65) Prior Publication Data

US 2006/0258208 A1 Nov. 16, 2006

Related U.S. Application Data

(63) Continuation of application No. 10/951,736, filed on Sep. 27, 2004, now Pat. No. 7,029,323.

(51) Int. Cl.
*H01R 9/05* (2006.01)

(52) U.S. Cl. ..... 439/578; 439/557

(58) Field of Classification Search ..... 439/544–567, 439/569–572

See application file for complete search history.

(56) References Cited

U.S. PATENT DOCUMENTS

| | | | | |
|---|---|---|---|---|
| 3,358,262 | A | 12/1967 | Schumacher | |
| 3,471,825 | A | 10/1969 | Huber | |
| 3,573,716 | A | 4/1971 | Garver | |
| 3,670,289 | A | 6/1972 | Bruner | |
| 3,852,700 | A | 12/1974 | Haws | |
| 3,989,343 | A | 11/1976 | Lucius et al. | |
| 4,541,036 | A | 9/1985 | Landries et al. | |
| 4,687,291 | A | 8/1987 | Stape et al. | |
| 4,749,968 | A | 6/1988 | Burroughs | |
| 4,768,961 | A | 9/1988 | Lau | |
| 4,815,104 | A | 3/1989 | Williams et al. | |
| 4,836,804 | A | 6/1989 | London et al. | |
| 4,998,889 | A | 3/1991 | Moly | |
| 5,147,992 | A | 9/1992 | Eriksen et al. | |
| 5,214,673 | A | 5/1993 | Morgenstern et al. | |
| 5,238,426 | A | 8/1993 | Arnett | |
| 5,246,378 | A | 9/1993 | Seiceanu | |
| 5,295,859 | A | 3/1994 | Kawai et al. | |
| 5,348,491 | A | 9/1994 | Louwagie et al. | |
| 5,366,388 | A | 11/1994 | Freeman et al. | |
| 5,413,494 | A | 5/1995 | Dewey et al. | |
| 5,467,062 | A | 11/1995 | Burroughs | |
| 5,538,438 | A | 7/1996 | Orlando | |
| 5,607,323 | A * | 3/1997 | Foster et al. | 439/557 |
| 5,913,701 | A | 6/1999 | Olson et al. | |

(Continued)

FOREIGN PATENT DOCUMENTS

DE 297 19 333 U1 2/1999

OTHER PUBLICATIONS

Brochure, "Video Signal Distribution Products," *ADC Telecommunications*, pp. 1-47 (Oct. 1996).

*Primary Examiner*—Ross N Gushi
(74) *Attorney, Agent, or Firm*—Merchant & Gould P.C.

(57) ABSTRACT

The present disclosure relates to a connector having a main body portion and a housing portion. The housing mounts over the connector main body. The housing is adapted for securing the connector to another element such as a piece of telecommunications equipment.

18 Claims, 10 Drawing Sheets

U.S. PATENT DOCUMENTS

| | | | |
|---|---|---|---|
| 6,019,521 | A | 2/2000 | Manning et al. |
| 6,099,350 | A | 8/2000 | Wright |
| 6,287,149 | B1 | 9/2001 | Elkhatib et al. |
| 6,352,444 | B1 | 3/2002 | Yuzawa |
| 6,409,534 | B1 | 6/2002 | Weisz-Margulescu |
| 6,450,829 | B1 | 9/2002 | Weisz-Margulescu |
| 6,533,616 | B2 | 3/2003 | Johnsen et al. |
| 6,986,680 | B2 * | 1/2006 | Wu ..... 439/551 |
| 7,077,697 | B2 * | 7/2006 | Kooiman ..... 439/557 |
| 2002/0076964 | A1 | 6/2002 | Weisz-Margulescu |
| 2004/0014365 | A1 | 1/2004 | Norris et al. |

* cited by examiner

FIG. 13
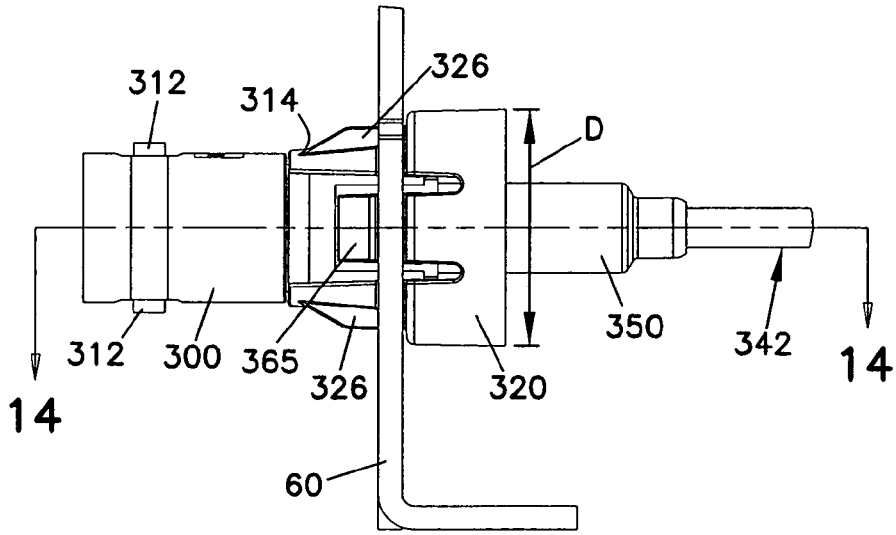
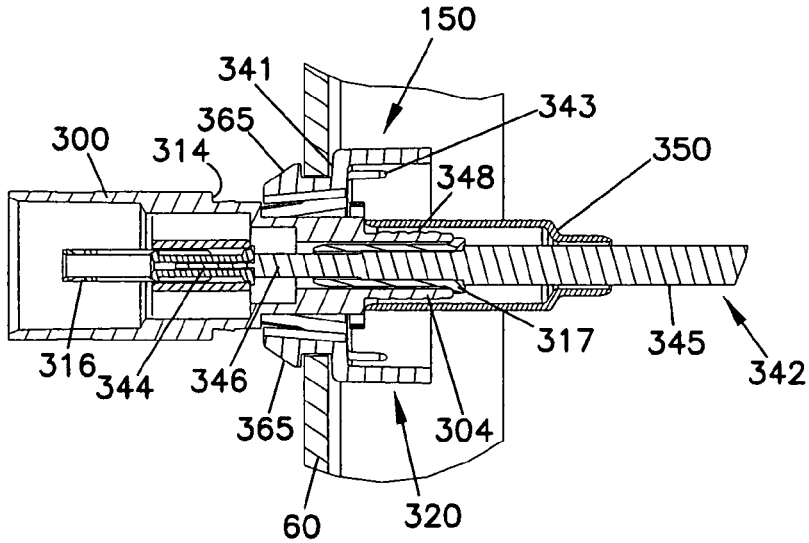
FIG. 14

FIG. 15
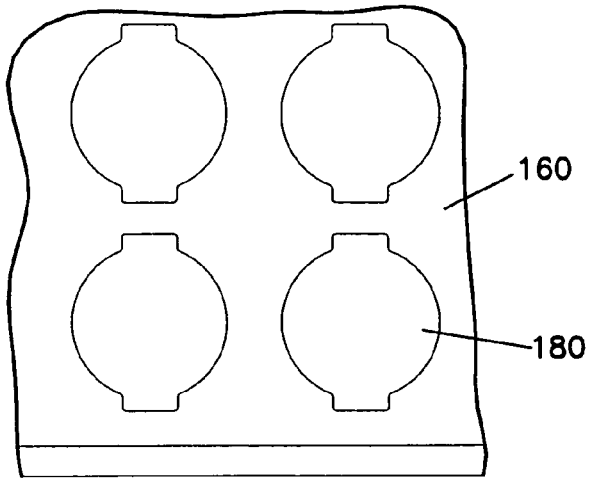
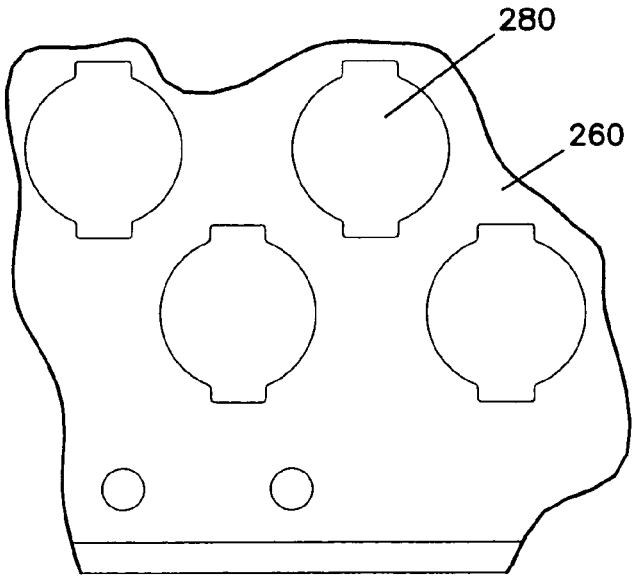
FIG. 16

HIGH DENSITY MOUNT FOR A CO-AXIAL CONNECTOR

This application is a continuation of application Ser. No. 10/951,736, filed Sep. 27, 2004, now U.S. Pat. No. 7,029, 323, which is incorporated herein by reference.

TECHNICAL FIELD

The principles disclosed herein relate generally to electrical connectors. More specifically, the disclosure relates to telecommunications connectors.

BACKGROUND

In the telecommunications industry, connectors are used to interconnect cables to pieces of telecommunications equipment or to other circuitry (e.g., switches). U.S. Pat. No. 5,913,701, which is incorporated herein by reference in its entirety, shows connectors 60 and 60' mounted to the back wall of a digital cross-connect (DSX) module. In addition to modules, connectors are also frequently mounted to other structures such as telecommunications panels, frames, chassis, PC boards or other telecommunications components.

SUMMARY

The present disclosure describes embodiments relating to a connector having a connector main body and a housing that mounts over the connector main body. The housing is adapted for securing the connector to another element such as a piece of telecommunications equipment.

BRIEF DESCRIPTION OF THE DRAWINGS

The accompanying drawings, which are incorporated in and constitute a part of the specification, illustrate various embodiments that are examples of how certain inventions can be put into practice. A brief description of the drawings is as follows:

FIG. 13 is a side view of the panel of FIG. 12B;

FIG. 14 is a cross-sectional view taken along section line 14-14 of FIG. 13; and FIGS. 15 and 16 show front views of portions of two panels similar to the panels of FIG. 11, the panels having two alternative mounting-hole patterns.

DETAILED DESCRIPTION

Figure 1:
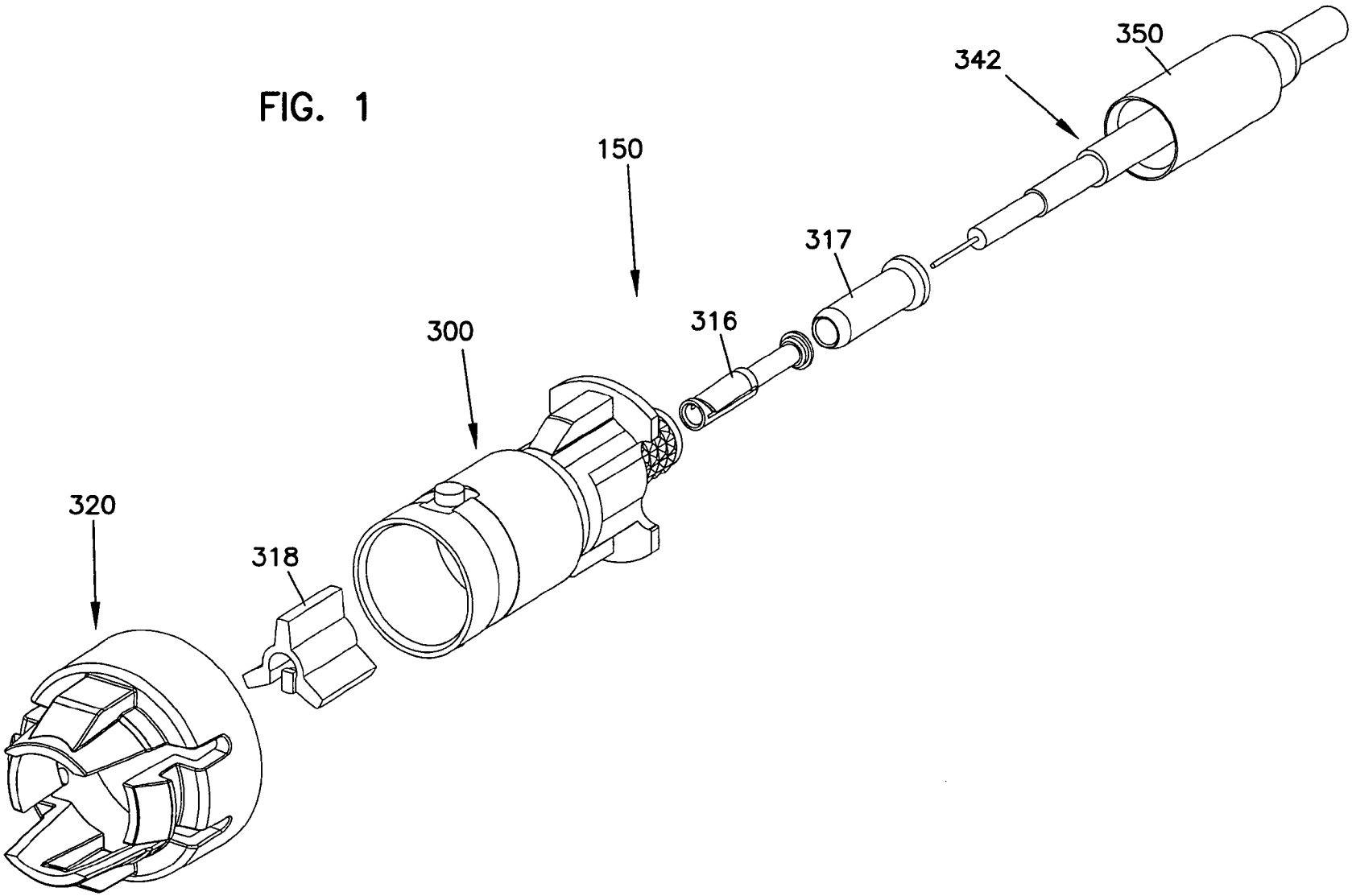
FIG. 1 is an exploded view of a connector having features that are examples of inventive aspects in accordance with the present disclosure.
Figure 2:
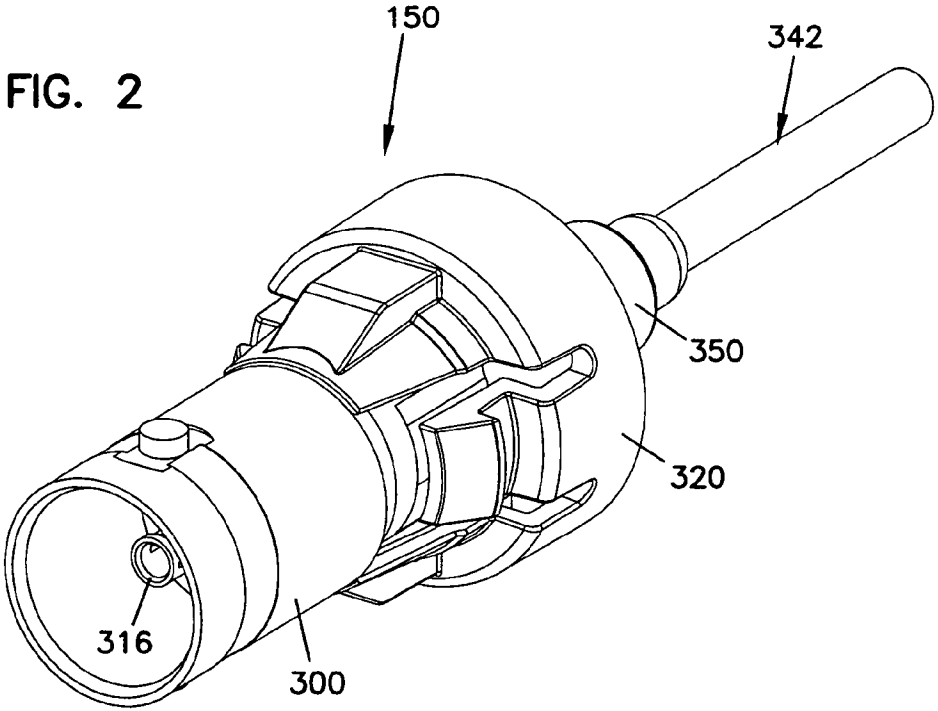
FIG. 2 is a front perspective view of the connector of FIG. 1, the connector is shown in a fully assembled configuration.
Figure 3:
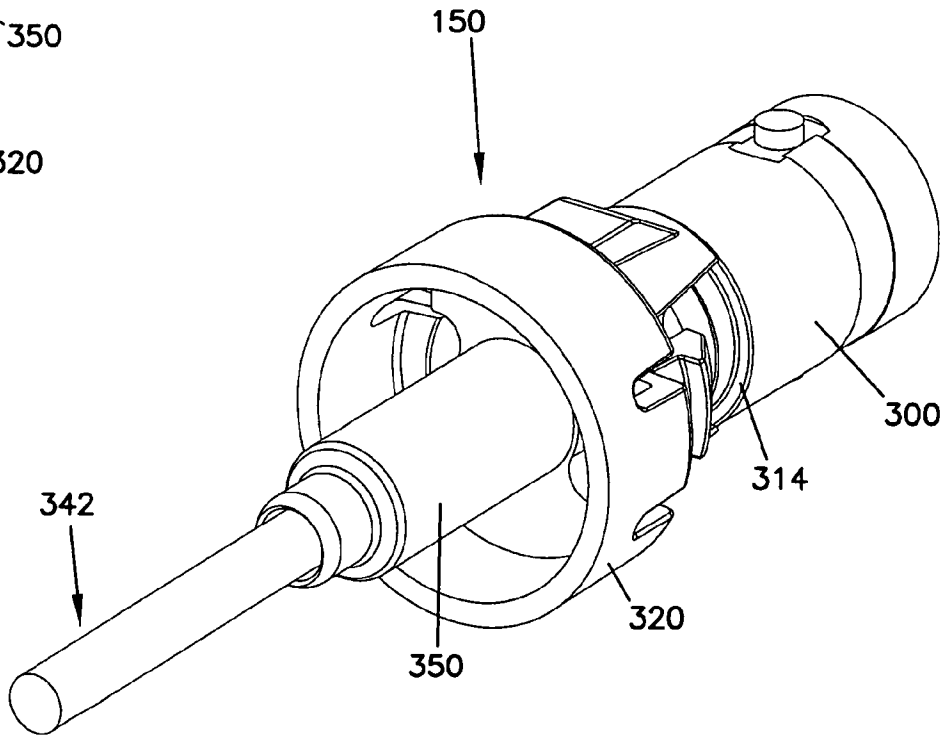
FIG. 3 is a back perspective view of the connector of FIG. 2.
Figure 4:
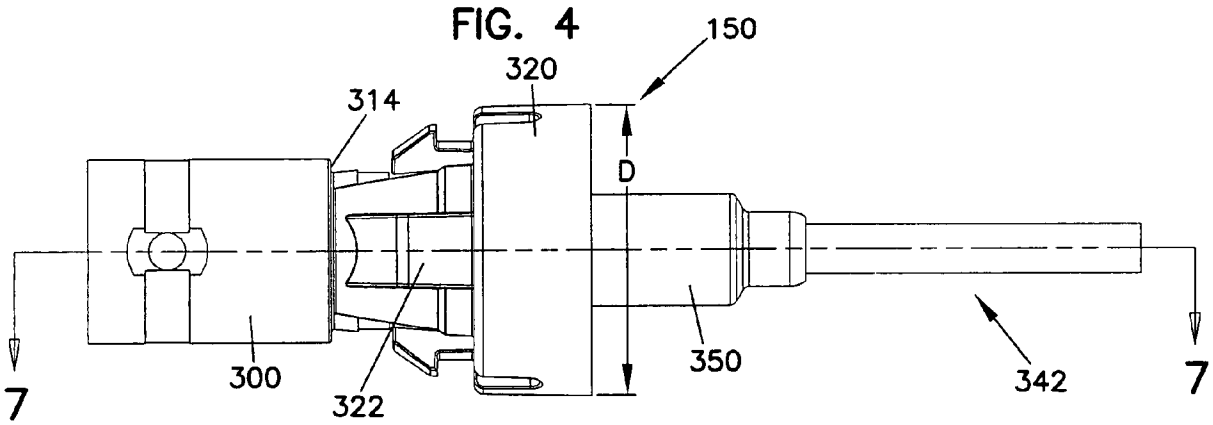
FIG. 4 is a side view of the connector of FIG. 2.

FIGS. 1-7 illustrate a connector 150 having features that are examples of how various inventive concepts disclosed herein can be practiced. The connector 150 includes a bulkhead 300, a center conductor 316 supported within the bulkhead 300, a dielectric spacer 318, an insert 317, cable 342, a crimp bushing 350 (e.g., a ferrule) crimped over the cable, and a housing 320 that mounts about the bulkhead 300.

The bulkhead 300 can also be referred to as a "conductor support" since it functions to hold the conductor 316, or a "connector main body". As will be described below, the housing 320 includes structure for securing the connector 150 to a piece of telecommunications equipment or other structure.

A. Bulkhead and Cable Termination

Figure 8:
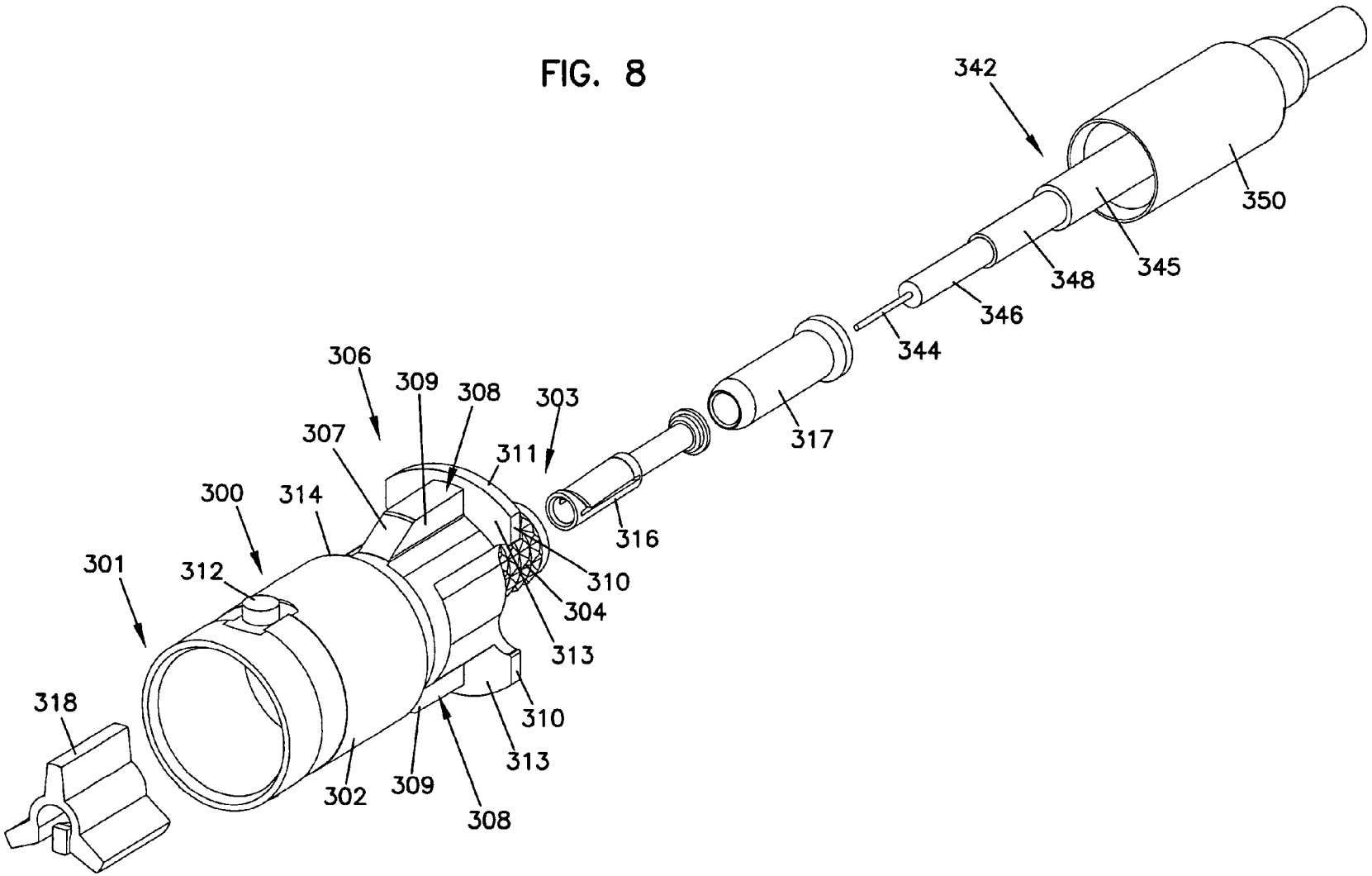
FIG. 8 is an exploded view showing a dielectric spacer, a connector main body, a center conductor, an insert, a stripped cable, and a bushing crimped over the cable, all of the connector of FIG. 1.

Referring to FIG. 8, the bulkhead 300 of the connector 150 includes a connector sleeve 302 and a crimp-supporting sleeve 304. The sleeves 302, 304 are positioned at opposite ends, the front end 301, the back end 303, respectively, of the bulkhead 300. The connector sleeve 302 is configured to provide a connection with a co-axial cable connector such as a BNC type connector (Bayonet Normalized Connector). As used herein, the term co-axial cable connector includes connectors adapted for terminating co-axial cables. Co-axial cable connectors generally include a center conductor pin and an outer connector sleeve offset from the central conductor pin. It will be appreciated that the sleeve can have different configurations to correspond to different styles of connectors such as the TNC style connectors (Threaded Normalized Connectors), 1.6/5.6 style connectors, type 43 connectors, SMZ connectors, SMB connectors, or 1.0/2.3 style connectors. The crimp-supporting sleeve 304 includes structure for enhancing a crimp (e.g., knurling, ridges, surface roughness, bumps, etc.).

The bulkhead 300 also includes a housing mount 306 positioned between the sleeves 302, 304. Preferably the housing mount 306 is integrally or unitarily formed as a single piece with the bulkhead 300. The housing mount 306 includes a pair of radially-arranged guide rails 308 that project outwardly from opposite sides of the bulkhead 300. The guide rails 308 are generally elongate and extend in the axial direction. Each of the guide rails 308 has a generally square configuration with parallel sidefaces 309. Each guide rail 308 also includes a ramped front face 307. The housing mount 306 also includes a pair of flanges 310 located behind the guide rails 308 adjacent the crimp-supporting sleeve 304. The flanges 310 are arranged perpendicular to the guide rails 308 and project outwardly from the bulkhead 300. Each of the flanges 310 includes a curved outer edge 311 and a flat front face 313. The bulkhead 300 defines a lip 314 adjacent the front of the guide rails 308, where the housing mount 306 meets the connector sleeve 302 portion of the bulkhead 300 (best seen in FIGS. 3, 4, 7, 13 and 14). The bulkhead 300 also includes a pair of tabs 312 radially arranged adjacent the front end 301 (best seen in FIGS. 5, 7 and 13).

Still referring to FIG. 8, the center conductor 316 of the connector 150 preferably mounts within the connector sleeve 302. The dielectric spacer 318 is provided for centering the center conductor 316 within the connector sleeve 302. When a BNC conventional connector (not shown) is coupled to the connector 150, a center pin of the BNC connector fits within the center conductor 316, an outer conductor sleeve presses within the sleeve 302, and a twist collar fits over sleeve 302 and receives tabs 312 of the bulkhead 300 to lock the connectors together. The crimp-supporting sleeve 304 is hollow for receiving the cable 342, which is terminated to the center conductor 316.

Figure 7:
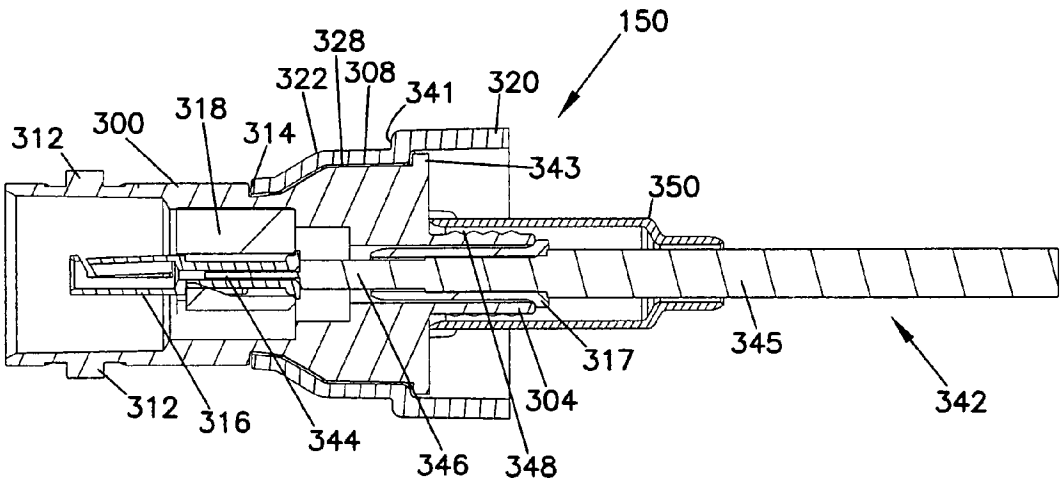
FIG. 7 is a cross-sectional view taken along section line 7-7 of FIG. 4.
Figure 6:
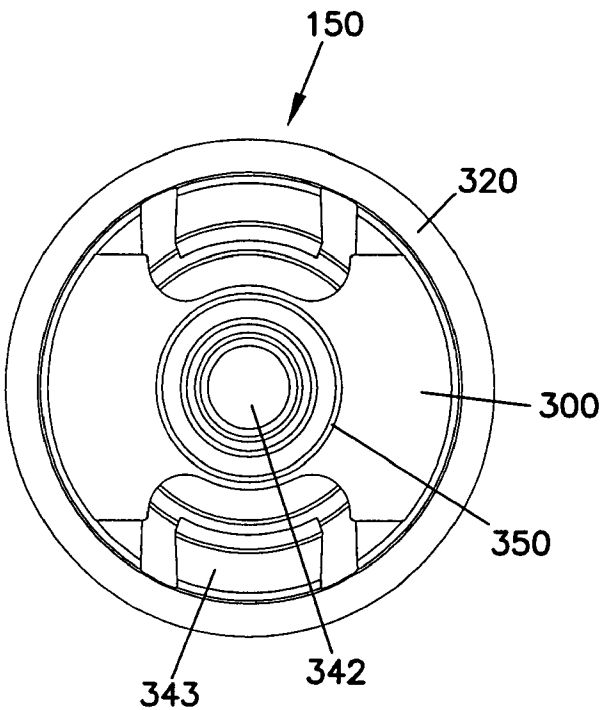
FIG. 6 is a back view of the connector of FIG. 2.
Figure 5:
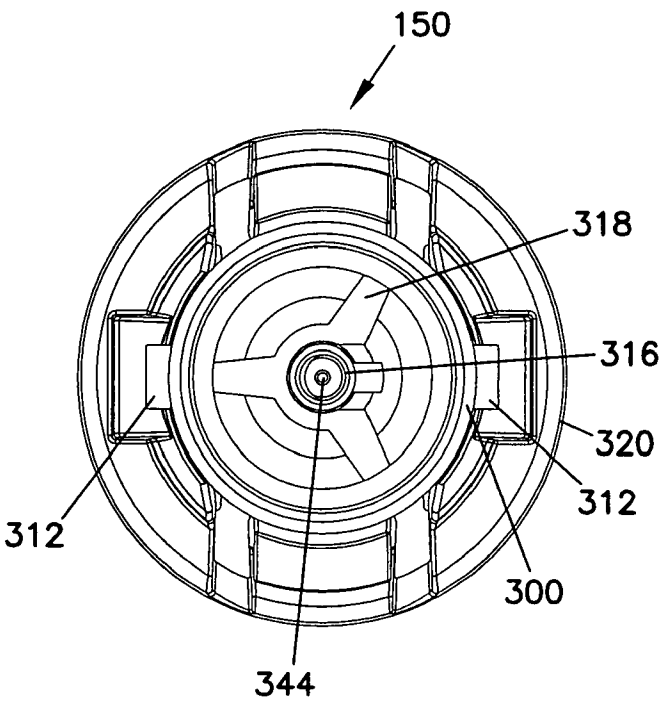
FIG. 5 is a front view of the connector of FIG. 2.

To terminate a cable 342 within the connector 150, the cable 342 is preferably stripped as shown in FIG. 8. In the stripped configuration, within the outer casing 345, the cable 342 includes an exposed central wire 344, an exposed cladding portion 346, and an exposed reinforcing shield 348. The reinforcing shield 348 may be braided. As best shown in FIGS. 7 and 14, the exposed wire 344 is preferably crimped within the center conductor 316 after the insert 317 is placed over the exposed cladding portion 346. The center conductor 316 is positioned within the bulkhead 300 of the connector 150. To mechanically secure the cable 342 to the connector 150, the exposed reinforcing shield 348 is inserted over the crimp-supporting sleeve 304 of the bulkhead 300 as shown in FIG. 7. The crimp bushing 350 is then crimped over the shield 348 to hold the shield 348 in place.

Figure 9:
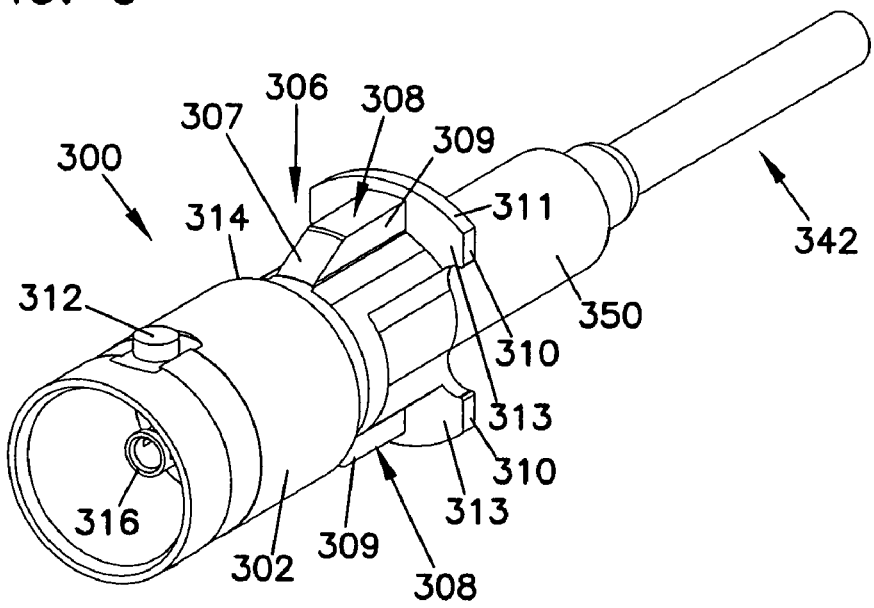
FIG. 9 is a front perspective view showing the components of FIG. 8 in a fully assembled configuration.

FIG. 9 shows the bulkhead 300 of the connector 150, with the cable 342 terminated within the bulkhead 300.

In one embodiment, the bulkhead 300 is constructed of a metal material such as zinc die cast alloy. However, it will be appreciated that other materials can also be used.

B. Housing

Figure 10:
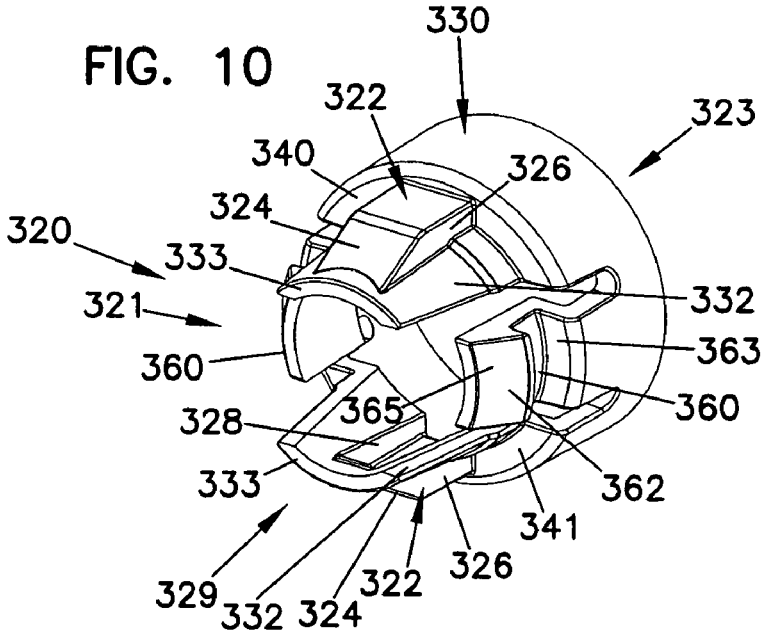
FIG. 10 is a front perspective view of a housing of the connector of FIG. 1.

Referring to FIG. 10, the housing 320 of the connector 150 includes a front end 321 and a back end 323. The housing includes a front mounting portion 329 at the front end 321 and a base portion 330 at the back end 323.

The housing 320 preferably has an internal configuration that complements the outer configuration of the housing mount 306 of the bulkhead 300. For example, as shown in FIGS. 1, 7 and 10, the housing 320 includes a pair of shoulders 322 radially arranged on opposite sides of the housing 320. The shoulders 322 are generally elongate and extend in the axial direction of the housing 320. Each of the shoulders 322 includes a ramped front face 324 and has a generally of square configuration with parallel sidefaces 326. The underside of the shoulders 322 define grooves 328 that complement the exterior configuration of the guide rails 308 of the bulkhead 300, as shown in FIG. 7. As such, when the bulkhead 300 is received within the housing 320, the guide rails 308 are received within the grooves 328. The ramped front face 307 of each guide rail 308 is adapted to abut against the underside of the ramped front face 324 of each shoulder 322. The sidefaces 309 of each guide rail 308 are adapted to abut against the underside of the sidefaces 326 of each shoulder 322 to prevent the bulkhead 300 from rotating within the housing 320 once inserted therewithin. While the guiderails 308 and the grooves 328 are depicted as having square configuration, it will be appreciated that other shapes could also be used.

The housing 320 includes a pair of arms 332, on which the shoulders 322 are defined, that extend axially from the base portion 330 of the housing toward the front end 321. Each arm 332 includes a curved interior surface adapted to complement the exterior of the connector sleeve 302 of the bulkhead 300. The arms 332 include front edges 333 that are adapted to abut against the lip 314 defined around the perimeter of the bulkhead 300 when the bulkhead 300 is inserted within the housing 320. The front edges 333 of the arms 332 abutting against the lip 314 prevent the bulkhead 300 from moving axially rearwardly relative to the housing 320 once inserted therewithin.

In the depicted embodiment, the base portion 330 of the housing 320 includes a generally rounded outer surface. It will be appreciated that other shapes can also be used. As used herein, "rounded" refers to any shape that is generally curvate including cylindrical, elliptical, oval, etc. The base portion 330 preferably has a cross-dimension (e.g., diameter) D (best seen in FIGS. 4 and 13) that is less than 1 inch. More preferably, the base portion 330 has a cross-dimension D less than 0.75 inches. Most preferably, the base portion 330 has a cross-dimension D of about 0.625 inches. It should be noted that the cross-dimension D is about 0.625 inches if used to provide a connection with a BNC type connector. Of course, in certain other embodiments, the size may vary from those specifically referenced above. For example, in certain embodiments that are adapted to be used with other types of connectors such as type 43 connectors, 1.6/5.6 connectors, 1.0/2.3 connectors, etc., the cross-dimension may be much smaller than 0.625 inches.

The base portion 330 of the housing 320 defines a flange 340 radially arranged around the perimeter of the housing. The flange 340 defines an exterior front face 341 and an interior back face 343, at the underside of the flange 340 (best seen in FIGS. 6, 7, and 14). The interior back face 343 is configured to abut the front face 313 of each of the flanges 310 defined on the housing mount 306 when the bulkhead 300 is inserted within the housing 320. The front faces 313 of the flanges 310 abutting against the interior back face 343 prevent the bulkhead 300 from moving axially forwardly relative to the housing 320 once inserted therewithin.

The bulkhead 300 is inserted into the housing 320 from the back end 323 of the housing 320. During insertion of the bulkhead 300 into the housing 320, front tabs 312 of the bulkhead 300 may act as guide members for aligning the guide rails 308 with the internal grooves 328 of the housing 320. During insertion, the tabs 312 are inserted into the grooves 328 of the housing 320 and slid within the grooves 320 until they reach the end of the grooves 328. When the tabs 312 reach the underside of the ramped faces 324 of the shoulders 322, further sliding of the tabs 312 causes the arms 332 to deflect radially outwardly until the tabs 312 are pushed past the arms 332. Due to their inherent elasticity, the arms 332 deflect back radially inwardly after the tabs 312 are pushed past the arms. Even after the tabs 312 are pushed past the arms, the arms 332 stay slightly deflected by the exterior of the connector sleeve 302. The arms 332 stay deflected until the front edges 333 of the arms reach the lip 314 defined around the bulkhead 300. At that point, the arms 332 deflect radially inwardly to their original non-deflected position.

As discussed above, the sidefaces 309 of each guide rail 308 abut against the underside of the sidefaces 326 of each shoulder 322 to prevent the bulkhead 300 from rotating within the housing 320 once inserted therewithin. The front edges 333 of the arms abutting against the lip 314 prevent the bulkhead 300 from moving axially backwardly relative to the housing 320 once inserted therewithin. The front faces 313 of the flanges 310 abutting against the interior back face 343 of the flange 340 prevent the bulkhead 300 from moving axially forwardly relative to the housing 320 once inserted therewithin. As such, the bulkhead 300 is fixedly locked within the housing 320 once inserted therewithin. By flexing the arms 332 outwardly while pushing the bulkhead 300 in the opposite direction to the direction of insertion, the bulkhead 300 can be separated from the housing.

The housing of the connector preferably includes structure for providing a snap-fit connection between the connector 150 and a piece of telecommunications equipment (e.g., a jack module or a panel such as the cross-connect panel shown in FIGS. 11-14). As shown in FIGS. 1, 2, 4 and 10, the housing 320 includes resilient cantilever arms 360 located on opposite sides of the housing 320. The resilient cantilever arms 360 extend axially from the base portion 330 of the housing toward the front end 321. Each cantilever arm 360 includes a tab 362. The tab 362 includes a ramp surface 365. A gap 363 is defined between each tab 362 and the exterior front face 341 of the flange 340 defined by the base portion 330 of the housing 320. As will be discussed in further detail below, the gap 363 is configured to receive the peripheral edge of an opening of a panel such as the cross-connect panel shown in FIGS. 11-14.

As used herein, the phrase "snap-fit connection" means a connection provided by a resilient member that flexes or deforms past a retaining structure and moves to a locking or retaining position by the inherent flexibility or elasticity of the resilient member. In the above described embodiment, the cantilever arms 360 move or "snap" past the panel by the inherent bias of the arms. The term snap-fit connection is not limited to resilient arms, but includes any structure (e.g., bumps, tabs, shoulders, etc.) that is deformed during insertion and moves to a retaining position by the inherent elasticity of the structure.

In one embodiment, the housing is made of a dielectric plastic material such as polycarbonate. However, other materials could also be used.

C. Cross Connect Panel

Figure 11:
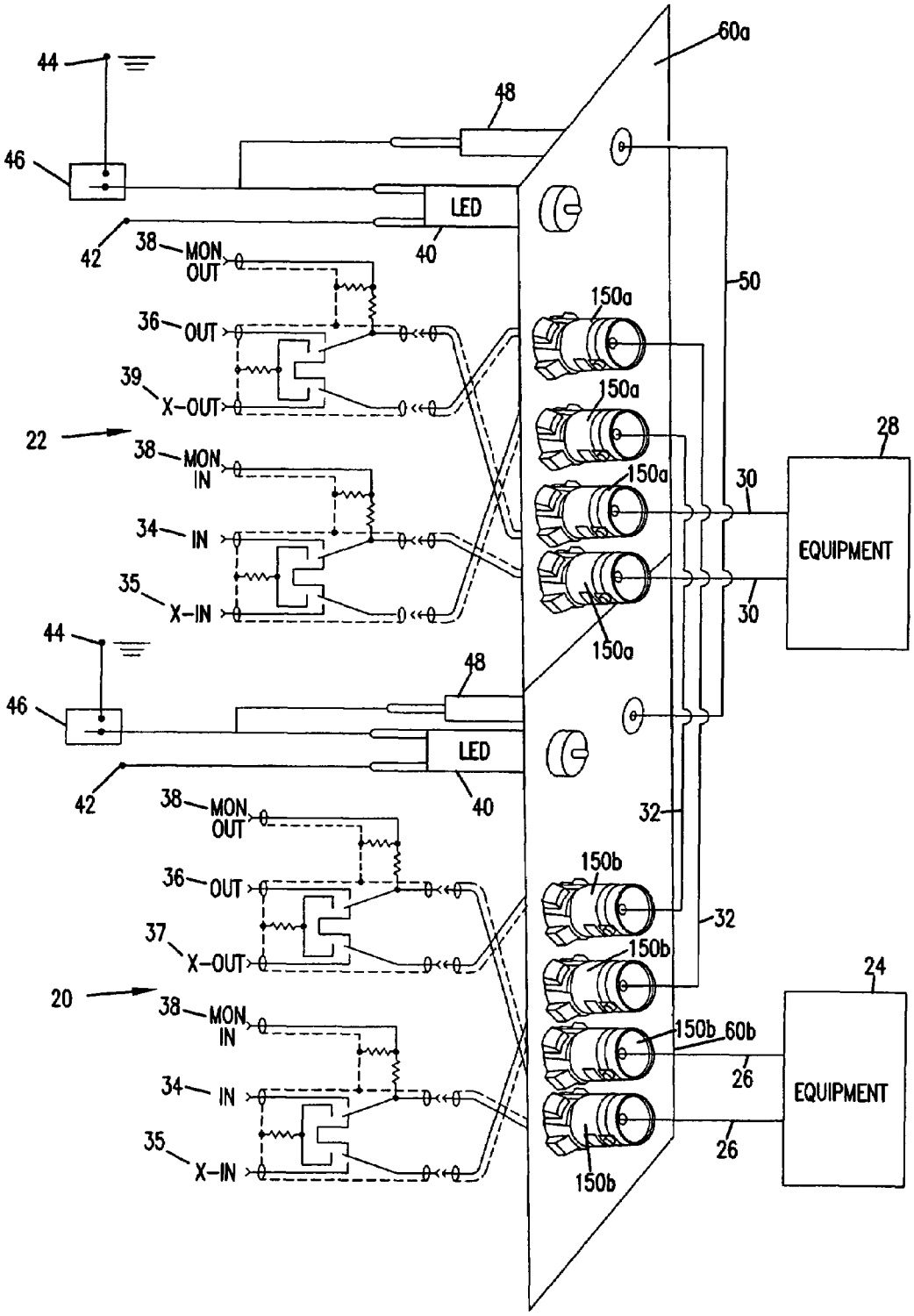
FIG. 11 shows a schematic view of a cross-connect arrangement of the type used for co-axial applications in combination with a diagrammatic view showing the face of two panels including pin jacks, tracer lamps, and connectors having the same configuration as the connector of FIG. 1.

FIG. 11 shows a schematic view of a cross-connect arrangement of the type used for co-axial applications in combination with a diagrammatic view showing the face of two panels 60*a*, 60*b* (collectively referred to with reference number 60) that are part of the cross-connect system. The panels 60 are examples of pieces of telecommunications equipment to which the connector 150 can be secured. Connectors 150*a* X-OUT, 150*a* X-IN, 150*a* OUT, and 150*a* IN are shown mounted on the panel 60*a* and connectors 150*b* X-OUT, 150*b* X-IN, 150*b* OUT, and 150*b* IN are shown mounted on panel 60*b*, by such methods as will be described in further detail below.

The depicted cross-connect arrangement includes two DSX jack modules 20 and 22. Each jack module 20, 22 is cabled to a separate network element (i.e., piece of telecommunications equipment). For example, jack module 20 is connected to equipment 24 by cables 26 through connectors 150*b* IN and 150*b* OUT, and jack module 22 is connected to equipment 28 by cables 30 through connectors 150*a* IN and 150*a* OUT. The pieces of equipment 24 and 28 are interconnected by cross-connect jumpers 32 placed between the two jack modules 20 and 22 through connectors 150 X-IN and 150 X-OUT.

Each jack module 20, 22 includes IN and OUT ports 34 and 36 for direct access to the equipment's input and output signals. Each module 20, 22 also includes X-IN and X-OUT ports 35, 37 for providing direct access to the cross-connect input and cross-connect output signals. Ports 34-37 provide a means to temporarily break the connection between the pieces of equipment 24 and 28 that are cross connected together, and to allow access to the signals for test and patching operations. The jack modules 20, 22 also include monitor ports 38 for non-intrusive access to the input and output signals of each piece of telecommunications equipment 24, 28.

A typical telecommunications central office includes many jack modules and a large number of bundled cables interconnecting the modules. Consequently, absent indicators, it is difficult to quickly determine which two jack modules are cross connected together. To assist in this function, the jack modules 20, 22 include indicator lights 40 wired to power 42 and ground 44. Switches 46 are positioned between the indicator lights 40 and ground 44. The indicator lights 40 are also electrically connected to pin jacks 48 located at the rear of the jack modules 20, 22. The pin jacks 48 provide connection locations for allowing the tracer lamp circuits corresponding to each of the modules 20, 22 to be interconnected by a cable 50 (i.e., a wire). The cable 50 is typically bundled with the cross-connect cables 32. When either switch 46 is closed, the indicator lamps 40 corresponding to both of the jack modules 20, 22 are connected to ground and thereby illuminated. Thus, by closing one of the switches 46, the two jack modules 20, 22 that are cross connected can be easily identified by merely locating the illuminated tracer lamps.

D. Connector Mounting Technique

FIGS. 12A, 12B, 13, and 14 show more detailed views of a portion of the face of one of the cross-connect panels 60 of FIG. 11.

Figure 12A:
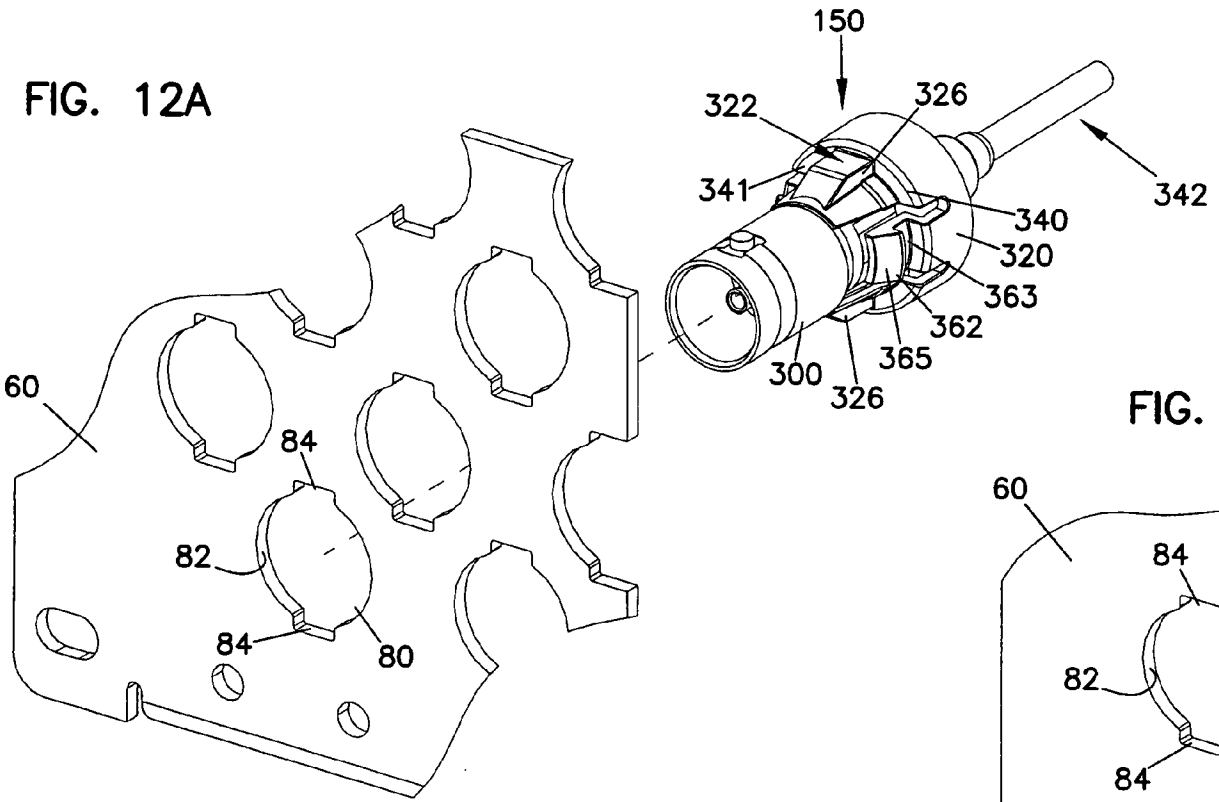
FIGS. 12A and 12B show more detailed perspective views of a portion of the face of one of the cross-connect panels of FIG. 11, illustrating the mounting of one of the connectors of FIG. 11 to the panel.
Figure 12B:
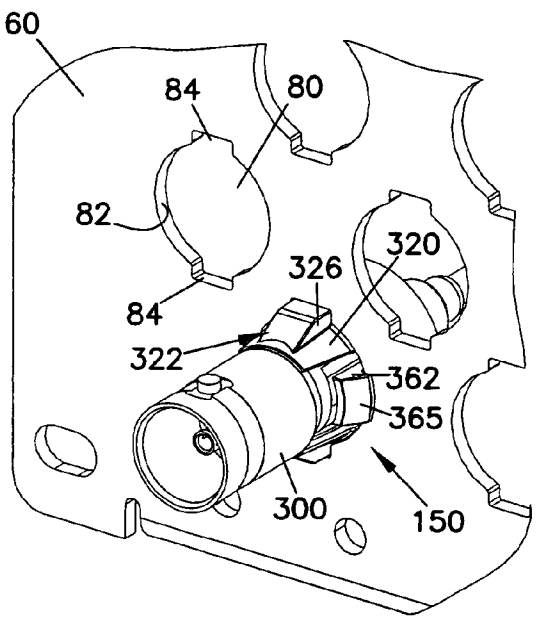

Referring to FIGS. 12A and 12B, the connector 150 is mounted to the panel 60 of the cross-connect system by being inserted through openings (mounting holes) 80 defined in the panel 60. As the connector 150 is inserted through the openings 80, the ramped surfaces 365 of the cantilever arms 360 contact opposing curved edges 82 defining the openings 80. The contact between the ramped surfaces 365 and the edges 82 of the openings 80 causes the cantilever arms 360 to flex inwardly. After the tabs 362 have moved completely through the openings 80, the cantilever arms 360 snap outwardly such that the edges 82 of the opening 80 are captured in the gap 363 defined between the tabs 362 and the exterior front face 341 of the flange 340, as seen in FIG. 14. As so positioned, the tabs 362 engage the front side of the panel 60 and the exterior front face 341 of the flange 340 engages the backside of the panel 60. Once snapped-in, the connector 150 is prevented from any movement in the axial direction relative to the panel 60. By flexing the cantilever arms 360 inwardly while pushing the connectors 150 in the opposite direction to the direction of insertion, the connector 150 can be removed from the openings 80.

The openings 80 of the panel 60 also define opposing keyslots 84. The keyslots 84 have a generally square configuration. The keyslots 84 are configured to accommodate the shoulders 322 defined on the housing 320 when the connector 150 is mounted to the panel 60. The keyslots 84 may act as an orientation feature for guiding the connectors 150 into the panel 60 during insertion to insure that the housing is positioned in a desired rotational orientation relative to the panel. Once inserted, the keyslots 84 also prevent rotation of the connector 150 within the panel 60 due to the sidefaces 326 of the shoulders 322 abutting against the edges of the keyslots 84.

FIGS. 16 and 17 show front views of portions of two panels 160 and 260 similar to the panels 60 of FIG. 11, the panels 160 and 260 having two alternative mounting hole patterns. The panel 160 includes mounting holes 180 that are arranged in a vertical and horizontal arrangement. The panel 260 includes mounting holes 280 that are arranged in a staggered arrangement.

It will be appreciated that many embodiments of the invention can be made without departing from the spirit and scope of the invention, and that the broad scopes of the inventions are not intended to be limited by the specific embodiments depicted and described herein.

We claim:

1. A connector comprising:

an electrically conductive main body including a generally cylindrical shape, the main body including a housing mount that projects outwardly from the main body; and a generally cylindrical housing that mounts axially over the housing mount of the main body with a snap-fit, wherein once mounted, the housing prevents the main body from rotating relative to the housing and prevents the main body from moving in an axial direction relative to the housing, the housing including an outer surface adapted for securing the connector to an opening defined by a piece of telecommunications equipment, the housing defining a base portion and first and second radially-opposed, radially-flexible arms that extend axially from the base portion, the first and second arms each defining a shoulder extending axially from the base portion, the first and second arms configured to flex radially outwardly to axially receive the main body of the connector, the housing defining third and fourth radially-opposed, radially-flexible arms that extend from the base portion, the third and fourth arms positioned between the first and second arms, respectively, the third and fourth arms configured to flex radially inwardly to secure the connector to the opening defined by the piece of telecommunications equipment.

2. A connector according to claim 1, wherein the main body defines an outer shell of a co-axial connector and wherein a center conductor of the co-axial connector is mounted within the main body with a dielectric spacer.

3. A connector according to claim 1, wherein the housing is a one-piece housing.

4. A connector according to claim 1, wherein the main body is adapted for connection to a BNC (Bayonet Normalized Connector) type connector.

5. A connector according to claim 1, wherein at least one of the shoulders of the housing is received within a key slot defined by the opening to prevent the connector from rotating relative to the piece of telecommunications equipment.

6. A connector according to claim 1, wherein the outer surface of the housing includes structure adapted to prevent the housing from moving axially relative to the piece of telecommunications equipment once the connector is secured to the opening.

7. A connector according to claim 1, wherein each shoulder defined on the first and second arms of the housing includes at least two parallel, flat surfaces.

8. A connector according to claim 1, wherein the shoulders defined on the first and second arms of the housing include ramped front faces.

9. A connector according to claim 1, wherein the base of the housing is circular.

10. A connector according to claim 1, wherein the housing includes a maximum diameter less than about 1 inch.

11. A connector according to claim 10, wherein the housing includes a maximum diameter less than about ¾ of an inch.

12. A connector according to claim 11, wherein the housing includes a maximum diameter of about 0.625 inches.

13. A connector according to claim 1, wherein the housing mount of the main body includes an elongated guide rail that projects outwardly from the main body, the guide rail disposed in an axial direction of the main body and wherein the housing includes an inner surface that receives the guide rail of the main body to prevent the housing from rotating relative to the main body.

14. A connector according to claim 13, wherein the guide rail comprises a shoulder with at least two parallel, flat surfaces.

15. A connector according to claim 14, wherein the inner surface of the housing defines a groove that complements an outer shape of the guide rail.

16. A connector according to claim 14, wherein the housing mount includes a pair of radially-opposed guide rails, each guide rail including a shoulder with at least two parallel, flat surfaces, wherein each guide rail includes a ramped front face.

17. A connector according to claim 16, wherein the housing includes a pair of radially-opposed grooves for receiving the pair of guide rails of the housing mount, the grooves including at least two parallel, flat surfaces.

18. A connector according to claim 17, wherein the grooves include ramped front surfaces.

* * * * *